United States Patent [19]

Suzuki et al.

[11] Patent Number: 4,999,016

[45] Date of Patent: Mar. 12, 1991

[54] HAND RECORDING APPARATUS

[75] Inventors: Takeshi Suzuki; Yuji Kagami, both of Tokyo, Japan

[73] Assignee: Canon Kabushiki Kaisha, Tokyo, Japan

[21] Appl. No.: 554,166

[22] Filed: Jul. 19, 1990

Related U.S. Application Data

[63] Continuation of Ser. No. 201,839, Jun. 3, 1988, abandoned.

[30] Foreign Application Priority Data

Jun. 8, 1987 [JP] Japan ..... 62-141506
Sep. 7, 1987 [JP] Japan ..... 62-221849

[51] Int. Cl.[5] ..... B41J 3/36

[52] U.S. Cl. ..... 400/88; 400/120; 346/76 PH; 346/139 R; 358/296

[58] Field of Search ..... 400/88, 19, 29, 120, 400/124, 120 HPC, 193; 346/76 R, 76 L, 76 PH, 139; 358/288, 293, 296; 250/317.1, 318

[56] References Cited

U.S. PATENT DOCUMENTS

| | | | |
|---|---|---|---|
| 2,428,378 | 10/1947 | Mossbach | 400/88 |
| 3,767,020 | 10/1973 | Rowe | 400/124 |
| 4,211,012 | 7/1980 | Alles et al. | 400/19 X |
| 4,319,283 | 3/1982 | Ozawa et al. | 358/286 |
| 4,523,235 | 6/1985 | Rajchman | 358/286 X |
| 4,611,246 | 9/1986 | Nihei | 358/293 X |
| 4,716,291 | 12/1987 | Sakamoto et al. | 250/318 |
| 4,750,049 | 6/1988 | Murakami et al. | 346/76 PH X |

FOREIGN PATENT DOCUMENTS

| | | | |
|---|---|---|---|
| 0138444 | 4/1985 | European Pat. Off. | 400/88 |
| 2905783 | 8/1980 | Fed. Rep. of Germany | 400/120 |
| 50-40289 | 12/1975 | Japan . | |
| 59-11074 | 6/1984 | Japan . | |
| 59-11078 | 6/1984 | Japan . | |
| 0114074 | 6/1984 | Japan | 400/120 |
| 0114078 | 6/1984 | Japan | 400/120 |
| 0118478 | 7/1984 | Japan | 400/29 |
| 59-145166 | 8/1984 | Japan . | |
| 0145166 | 8/1984 | Japan | 400/88 |
| 60-161166 | 8/1985 | Japan . | |
| 0240469 | 11/1985 | Japan | 400/88 |
| 0240470 | 11/1985 | Japan | 400/88 |
| 0240471 | 11/1985 | Japan | 400/88 |
| 0240472 | 11/1985 | Japan | 400/88 |
| 0029563 | 2/1986 | Japan | 400/88 |
| 0213184 | 9/1986 | Japan | 400/120 HPC |
| 0219670 | 9/1986 | Japan | 400/88 |
| 0280957 | 12/1986 | Japan | 400/88 |
| 0027161 | 2/1987 | Japan | 400/88 |
| 0116172 | 5/1987 | Japan | 400/88 |
| 0119066 | 5/1987 | Japan | 400/29 |
| 0161567 | 7/1987 | Japan | 400/120 |
| 0225372 | 10/1987 | Japan | 400/88 |
| 0244670 | 10/1987 | Japan | 400/88 |
| 0244683 | 10/1987 | Japan | 400/88 |
| 0248670 | 10/1987 | Japan | 400/88 |
| 0249762 | 10/1987 | Japan | 346/76 PH |
| 1366253 | 11/1974 | United Kingdom | 400/124 |

OTHER PUBLICATIONS

Research Disclosure, "Hand Held Serial Printer", Number 254, Jun. 1985, Kenneth Mason Publications Ltd, England.

*Primary Examiner*—Eugene H. Eickholt
*Attorney, Agent, or Firm*—Fitzpatrick, Cella, Harper & Scinto

[57] ABSTRACT

A hand recording apparatus for recording images on a recording medium by manual operation has an encode plate and a photosensor for detecting the movement of the apparatus body, a thermal head driven so as to record an image conforming to an image signal on the recording medium correspondingly to the movement of the apparatus body detected by the encode plate and the photosensor, and a driver for displacing the thermal head to a recording position in response to the contact of the apparatus body with the recording medium.

17 Claims, 11 Drawing Sheets

HAND RECORDING APPARATUS

This application is a continuation of application Ser. No. 07/201,839 filed June 3, 1988, abandoned.

BACKGROUND OF THE INVENTION

1. Field of the Invention

This invention relates to a hand recording apparatus for recording images on a recording medium by manual operation.

The hand recording apparatus is an apparatus which records images on a recording medium (such as plain paper, cloth or a plastic sheet) while being manually moved by an operator. It covers an apparatus connected to a body apparatus (such as a word processor or a typewriter) and effecting image recording in conformity with image information from said body apparatus, and an apparatus having an image information input mechanism in itself. The images include, for example, characters, numerals, patterns and figures.

2. Related Background Art

Nowadays word processors have spread wide, and output apparatuses generally used in these word processors include heat transfer type recording apparatus using an ink ribbon.

The construction of the heat transfer type recording apparatus is such that a recording head provided with a plurality of heat generating elements which generate heat in response to an image signal is carried on a movable carriage. The carriage is moved by a motor and the recording head is drivingly controlled so as to be in synchronism with the movement of the carriage, whereby the ink of the ink ribbon is melted into an image pattern or reduced in viscosity and transferred to recording paper.

The above-described heat transfer type recording apparatus, for its compactness, light weight and low noise, is widely used as the output apparatus of a word processor, a printer or the like.

However, the above-described recording apparatus, which has a carriage feeding mechanism and a recording paper feeding mechanism, is complicated in its general structure, and is limited in the thickness, size, etc. of the recording paper on which recording can be effected. That is, it suffers from the problem that it is difficult to effect recording on paper of a thickness exceeding a predetermined thickness, paper of large size and a booklet-like medium such as a notebook.

So, the applicant has already developed and proposed a recording apparatus which is not limited in the thickness and size of the recording medium on which recording is to be effected and which can effect recording even on a booklet-like recording medium. The application was filed Mar. 15, 1988 and bears Ser. No. 168,387, now abandoned.

The present invention is a further development of the technique mentioned just above.

SUMMARY OF THE INVENTION

It is an object of the present invention to provide a hand recording apparatus which can record clear-cut images on a recording medium.

It is another object of the present invention to provide a hand recording apparatus which can obviate any mistake in image recording.

It is still another object of the present invention to provide a hand recording apparatus which can record images on a recording medium while being manually moved by an operator.

It is yet still another object of the present invention to provide a hand recording apparatus in which when the apparatus body is brought into contact with a recording medium, a recording head is biased toward the recording medium by pressing means correspondingly thereto and when the apparatus body is manually or otherwise moved, detecting means detects the amount and speed of movement of the apparatus body and in conformity with the result of the detection, a transfer medium is conveyed and the recording head is driven, whereby predetermined image recording is accomplished on the recording medium.

It is a further object of the present invention to provide a hand recording apparatus in which recording means can be automatically displaced between a recording position and a retracted position in conformity with the contact and separation between the apparatus body and a recording medium.

It is still a further object of the present invention to provide a hand recording apparatus in which the possibility of recording means such as a recording head being damaged can be reduced.

It is yet still a further object of the present invention to provide a hand recording apparatus in which any slack of an ink sheet produced when recording means such as a recording head is returned into the apparatus body after recording is terminated can be eliminated.

It is another object of the present invention to provide a hand recording apparatus in which recording means can be retracted into and extended out of the apparatus body.

DESCRIPTION OF THE PREFERRED EMBODIMENTS

An embodiment of a hand recording apparatus to which the present invention is applied will hereinafter be described in detail with reference to the drawings The hand recording apparatus which will hereinafter be described has detecting means for detecting the movement of an apparatus body on a recording medium, conveying means for conveying a transfer medium in response to the movement of said apparatus body, a recording head for driving said transfer medium so as to transfer it to said recording medium in response to an image signal, and pressing means for pressing said recording head toward the recording side correspondingly to the contact and separation between said apparatus body and said recording medium.

Figure 1:
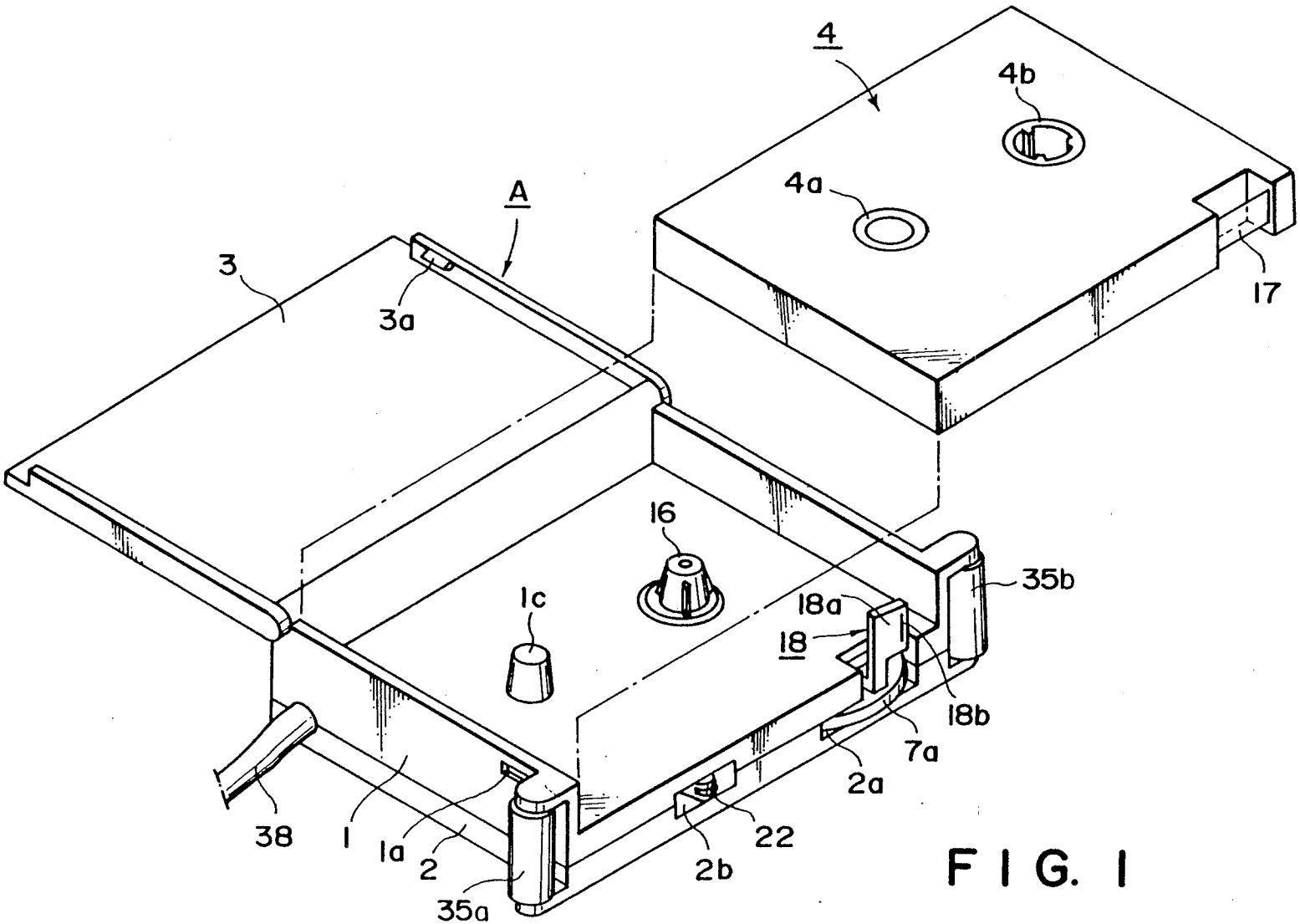
FIG. 1 is a perspective view of a manually scanned recording apparatus according to an embodiment of the present invention.
Figure 2:
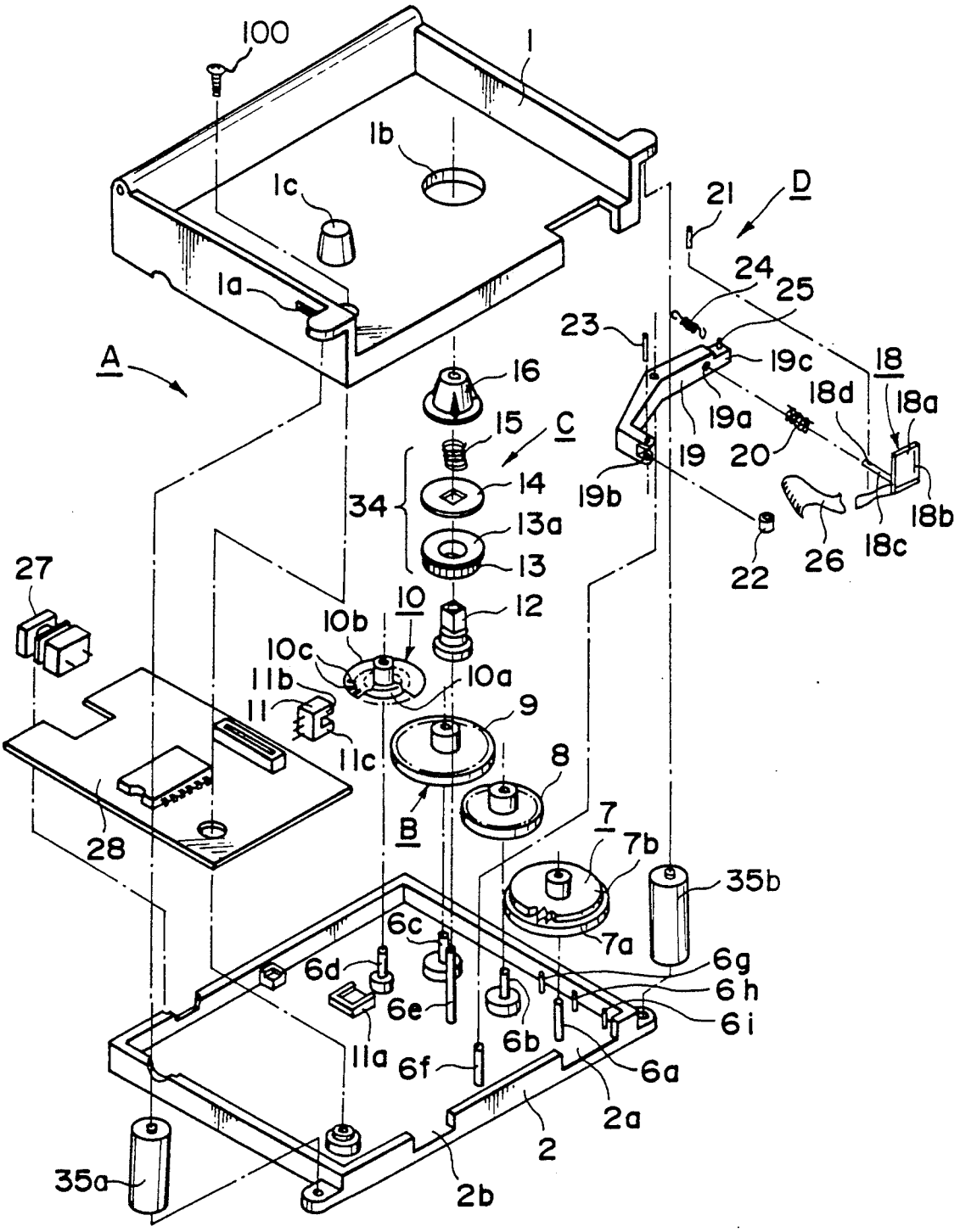
FIG. 2 is an exploded perspective view of the apparatus.
Figure 3:
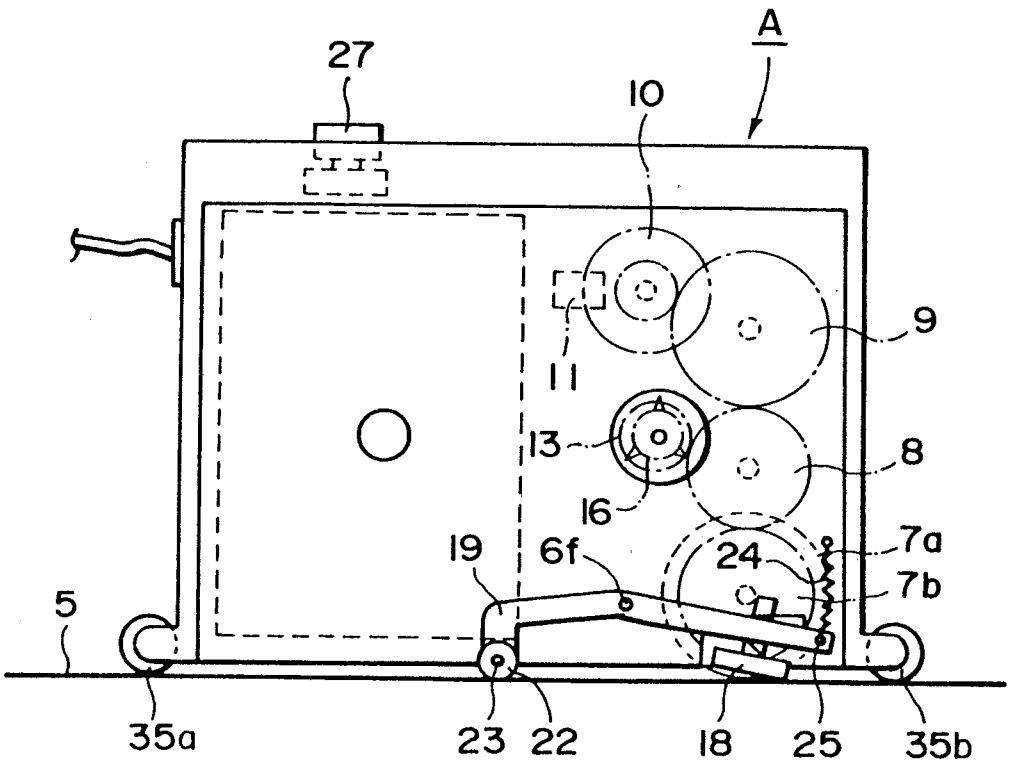
FIG. 3 is an illustration of the assembly of the apparatus.

FIG. 1 is a perspective view of the hand recording apparatus, FIG. 2 is an exploded view of the apparatus, and FIG. 3 illustrates the assembly of the apparatus.

Figure 4:
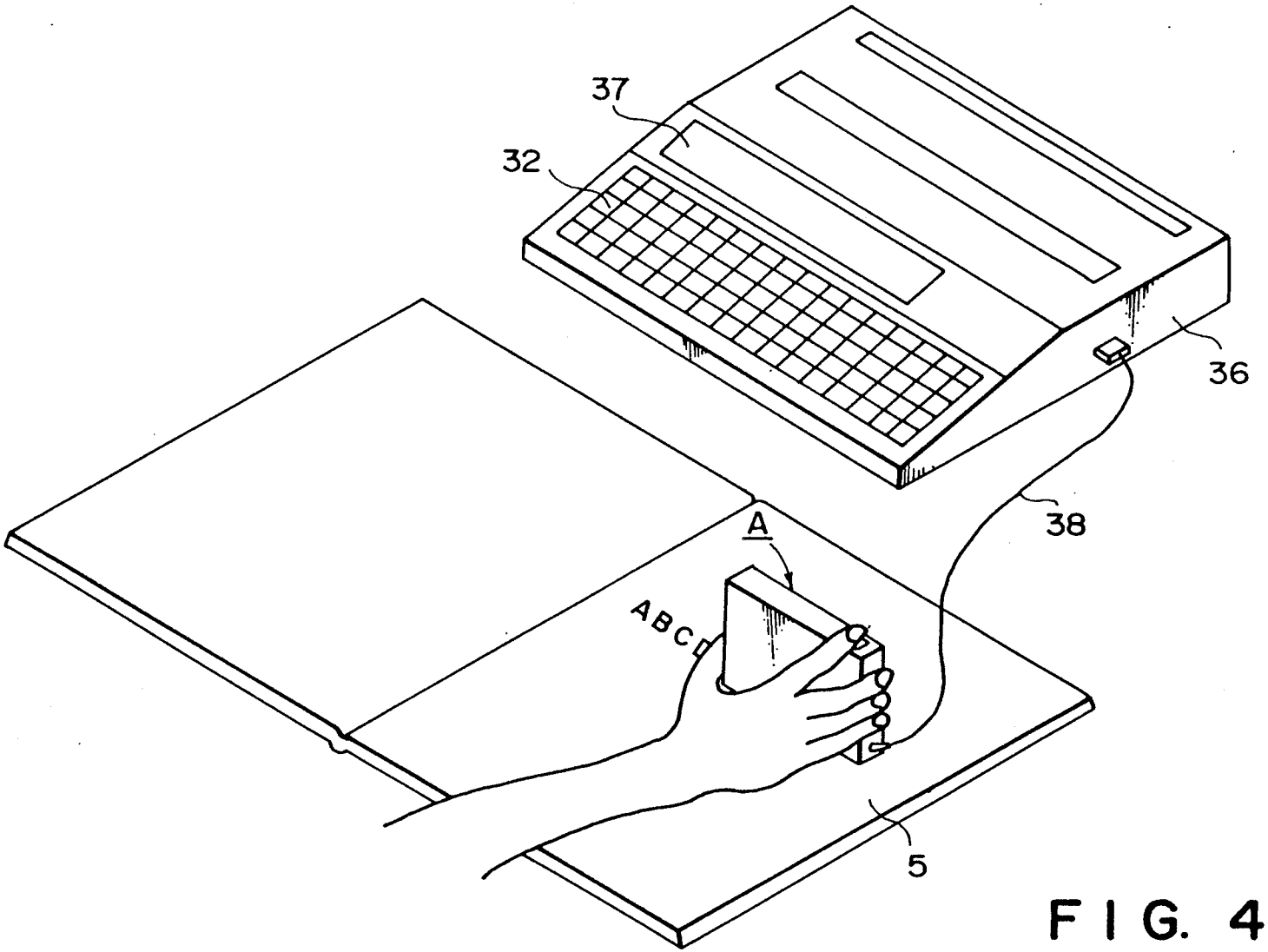
FIG. 4 illustrates a state in which the recording apparatus is operated

Referring to these figures, the letter A designates the apparatus body. An upper case 1 and a lower case 2 can be integrally secured to each other by the screws 100 or the like, and a lid member 3 is pivotally provided on the upper case 1. Locking pawls 3a are provided on the opposite side edges of the lid member 3 and are engageable with locking recesses la formed on the opposite sides of the upper case 1. An ink ribbon cassette 4 can be contained in the upper case 1. A detecting mechanism B for detecting the amount and speed of movement of the apparatus body A to be described, a conveying mechanism C for a transfer medium and a recording head mechanism D are contained between the upper and lower cases 1 and 2. The apparatus body A may be pushed against a recording medium (such as paper or plastic sheet, hereinafter referred to as "recording paper") as shown in FIG. 4 and may be manually or otherwise moved to thereby accomplish predetermined image recording.

The constructions of the mechanisms B, C and D will now be specifically described with reference to FIG. 2.

The detecting mechanism B will first be described. As shown, a rotating member 7 is rotatably mounted on the shaft 6*a* of the lower case 2. The member 7 is adapted to be rotated with movement of the apparatus body A. That is, the rotating member 7 is formed with a roller portion 7*a* and a gear portion 7*b* of smaller diameter than the roller portion 7*a*, and is mounted so that the roller portion 7*a* protrudes outwardly from the cut-away portion 2*a* of the lower case 2. Accordingly, when the apparatus body A is moved with the roller portion 7*a* being brought into contact with the recording paper 5, the rotating member 7 rotates in conformity with said amount and speed of movement. This rotation may be transmitted to the gear portion 10*a* of an encode plate 10 through an intermediate gear 8 meshing with the gear portion 7*b* and an intermediate gear 9 meshing with the gear 8. The gears 8 and 9 and the encode plate 10 are rotatably mounted on the shafts 6*b*, 6*c* and 6*d*, respectively, of the lower case 2.

The encode plate 10 has said gear portion 10*a* and a thin disc 10*b* of stainless steel or like material formed integrally with each other, and a plurality of rectangular slits 10*c* are formed radially in the marginal portion of the disc 10*b*. A photosensor 11 is provided at the position of the slits 10*c*. This photosensor sensor 11 has a light-emitting portion 11*b* and a lightreceiving portion 11*c*, and is mounted on the sensor mounting portion 11*a* of the lower case 2 so that the light from the light-emitting portion 11*b* passes through the slits 10*c* to the light-receiving portion 11*c*. Accordingly, when the rotating member 7 rotates, the encode plate 10 rotates correspondingly thereto and the photosensor 11 which has detected the slits 10*c* produces a pulse signal. The amount and speed of rotation of the rotating member 7 may be detected by this signal.

The conveying mechanism C for the transfer medium will now be described. As shown, a rectangular rotor 12 is rotatably mounted on the shaft 6*e* of the lower case 2. The rotor 12 is press-fitted into a roll-up shaft 16 with a gear 13, a disc 14 and a compression coil spring 15 interposed therebetween in the named order, the gear 13 meshing with the intermediate gear 8.

Also, the gear 13 is mounted for rotation relative to the rotor 12, and the disc 14 is loosely fitted against rotation relative to the rotor 12. A friction plate 13*a* formed of felt or the like is adhesively secured to the upper surface of the gear 13. The disc 14 is urged against the friction plate 13*a* by the biasing force of the coil spring 15 to thereby constitute a friction clutch 34.

The roll-up shaft 16 is designed so as to be exposed through an opening 1*b* formed in the upper case 1. A support shaft 1*c* is projectedly provided on the upper case 1. When the ink ribbon cassette 4 is inserted into the upper case 1, the supply reel 4*a* of the cassette 4 may be rotatably supported by the support shaft 1*c* and the take-up reel 4*b* may non-rotatably fit to the roll-up shaft 16.

An ink ribbon 17 which is the transfer medium is wound on the supply reel 4*a* and the take-up reel 4*b*, and the ink ribbon 17 may be paid away from the supply reel 4*a* to the roll-up reel 4*b* as the take-up reel 4*b* is rotated.

The ink ribbon 17 comprises a base film formed of polyethylene terephthalate film or the like, and ink meltable or reducible in viscosity by heating and applied onto the base film. The ink ribbon 17 is pressed from its base film side by a recording head 18 to be described, whereby it is loaded so that the surface thereof to which the ink is applied can contact the recording paper 5.

In the above-described construction, when the rotating member 7 rotates, the gear 13 rotates through the intermediary of the intermediate gear 8 and the rotational force thereof is transmitted to the disc 14 through the frictional force of the friction plate 13*a*, whereby the roll-up shaft 16 is rotated. Thereby the take-up reel 4*b* is rotated and the ink ribbon 17 is successively rolled up onto the take-up reel 4*b*.

During the rolling-up of the ink ribbon 17, no rotational force exceeding a predetermined level is transmitted to the roll-up shaft 16 due to the aforedescribed action of the friction clutch 34.

The recording head mechanism D will now be described. As shown, the recording head 18 comprises a head substrate 18*a* and heat generating elements 18*b* arranged in a row thereon which, when electrically energized, individually generate heat. The recording head 18 is loosely fitted in such a manner that a head shaft 18*c* provided on the back surface of the head substrate 18*a* unrotatably extends into a head mounting hole 19*a* in a head supporting arm 19 with a compression coil spring 20 interposed therebetween. The recording head 18 is mounted by fitting a pin 21 into a hole 18*d* formed at the end of the head shaft 18*c*. The head supporting arm 19 is formed substantially in an L-shape, and one end portion 19*b* thereof is formed in a forklike shape and has a roller 22 rotatably mounted therein by a pin 23. The other end portion 19*c* of the head supporting arm has a pin 25 projectedly provided thereon. A tension coil spring 24 is mounted between the pin 25 and the shaft 6*g* of the lower case 2. Also, the head supporting arm 19 has substantially the center thereof pivotally mounted on the shaft 6*f* of the lower case 2. Pins 6*h* and 6*i* provided on the lower case 2 are stoppers for contacting the end portion 19c of the head supporting arm 19 to thereby control the pivotal movement thereof.

When recording is not being effected, the recording head mechanism D constructed as described above is in such a state that the end portion 19c of the head supporting arm 19 is biased into contact with the pin 6h by the tension coil spring 24. In this case, the recording head 18 is retracted into the apparatus body A and the roller 22 provided on the end portion 19b of the head supporting arm 19 is exposed to the outside of the apparatus body A through the cut-away portion 2b of the lower case 2. Where recording is to be effected, when the operator places the apparatus body A on the recording paper 5 and presses it downward, the roller 22 comes into contact with the surface of the recording paper 5 and is pushed into the apparatus body A until the end portion 19c of the head supporting arm 19 bears against the pin 6a. At this time, the recording head 18 becomes exposed to the outside of the apparatus body A through the cut-away portion 2a of the lower case 2 with the ink ribbon 17. The recording head 18 then contacts the recording paper 5 and is biased by the compression coil spring 20, whereby the heat generating element 18b is urged against the film base surface of the ink ribbon 17.

The recording head 18, the photosensor 11 and a record initiating switch 27 are electrically connected to a circuit substrate 28 by a flexible substrate 26 or the like. A control circuit F to be described is provided on the circuit substrate 28, and the recording head 18 is drivingly controlled by this control circuit.

Figure 5:
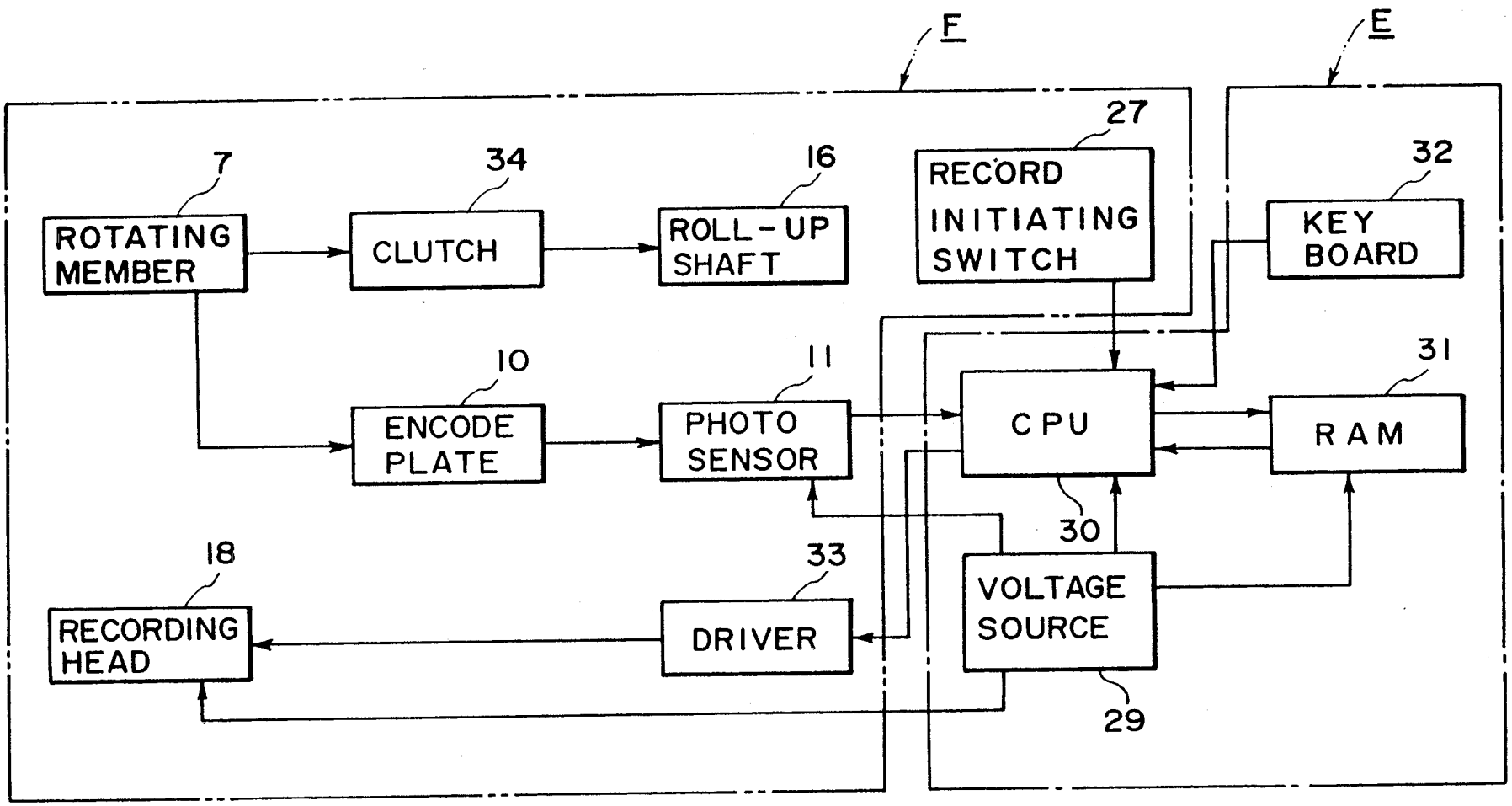
FIG. 5 is a block diagram of a control circuit

The control circuit is constructed as shown in FIG. 5. In FIG. 5, the portion encircled by a dots-and-dash line 9 is the circuit provided on the circuit substrate 28, and the portion E encircled by a dot-and-dash line is a circuit provided in an outside instrument such as a word processor.

The above-mentioned circuit will now be described. A voltage source 29 is supplied to CPU 30, the photosensor 11 and the recording head 18. The recording information input from a keyboard 32 is stored in RAM 31 through the CPU 30. When the record initiating switch 27 is depressed and the rotating member 7 is rotated, pulse signals successively enter the CPU 30 from the photosensor 11 which has detected the slits 10c of the disc 10b. The CPU 30 reads the recording information prestored in the RAM 31 in response to the signal from the photosensor 11, and supplies a signal to a driver 33 for driving the recording head 18. The heat generating element 18b of the recording head 18 generates heat in the form of an image pattern, whereby the ink of the ink ribbon 17 is transferred to the recording paper 5, thus accomplishing recording.

After recording, the ink ribbon 17 may be rolled up on the take-up reel 4b by the rotational force of the rotating member 7 being transmitted to the roll-up shaft 16 through the friction clutch 34.

Guide rollers 35a and 35b for guiding the movement of the apparatus body A are rotatably mounted on the opposite sides of the apparatus body A.

Description will now be made of a case where the recording apparatus constructed as described above is used.

As shown in FIG. 4, an outside instrument 36 for inputting recording information such as a word processor or an electronic typewriter, and the control circuit of the apparatus body A are electrically connected together by a cord 38.

When the recording information is to be input for example, by the keyboard 32 of the outside instrument 36 to thereby record the input information displayed on a display part 37, the operator urges the apparatus body A against booklet-like recording paper 5 such as a notebook so that the inked surface of the ink ribbon 17 contacts the recording paper 5. Thereupon, the roller 22 undergoes a downward force, thereby the head supporting arm 19 pivotally moves about the shaft 6f and the recording head 18 presses the recording paper 5 with the ink ribbon 17 interposed therebetween.

When in this state, the operator manually moves the apparatus body A while depressing the record initiating switch 27, the rotating member 7 which is in contact with the recording paper 5 rotates and the amount and speed of rotation thereof are detected by the encode plate 10 and the photosensor 11 That is, the amount of movement of the apparatus body A is detected by the pulse number from the initiation of the movement, and the speed of movement of the apparatus body A is detected by the pulse period. Correspondingly to the result of the detection, the recording information stored in the RAM 31 is read and the recording head 18 is driven in conformity with such information. Accordingly, even if the speed of movement of the apparatus body A is varied, image recording is effected always correspondingly to said speed.

Also, the roll-up shaft 16 is rotated by the rotation of the rotating member 7 resulting from the movement of the apparatus body A, and after recording, the ink ribbon 17 is successively rolled up on the take-up reel 4b.

As the ink ribbon 17 is rolled up, the diameter of the ink ribbon 7 rolled up on the take-up reel 4b varies. Accordingly, it is necessary to very the amount of rotation of the take-up reel 4b relative to the amount of movement of the apparatus body A. However, as previously described, a rotational torque corresponding to the amount of rotation of the rotating member 7 is transmitted to the roll-up shaft 16 through the friction clutch 34. Thus, irrespective of the variation in said diameter, the ink ribbon 17 is rolled up on the take-up reel 4b by an amount corresponding to the amount of rotation of the rotating member 7.

By moving the apparatus body A in the manner described above, recording can be accomplished and therefore, the recording medium is not limited to a sheet-like one, but recording can also be easily effected on a thick recording medium or a booklet-like recording medium. Also, the driving of the recording head 18 and the rotation of the roll-up shaft 16 take place in synchronism with the rotation of the rotating member 7 and therefore, it never happens that the ink ribbon 17 fails to be conveyed and only the recording head 18 is driven, and likewise, it never happens that the recording head 18 fails to be driven and only the ink ribbon 17 is conveyed.

Figure 6:
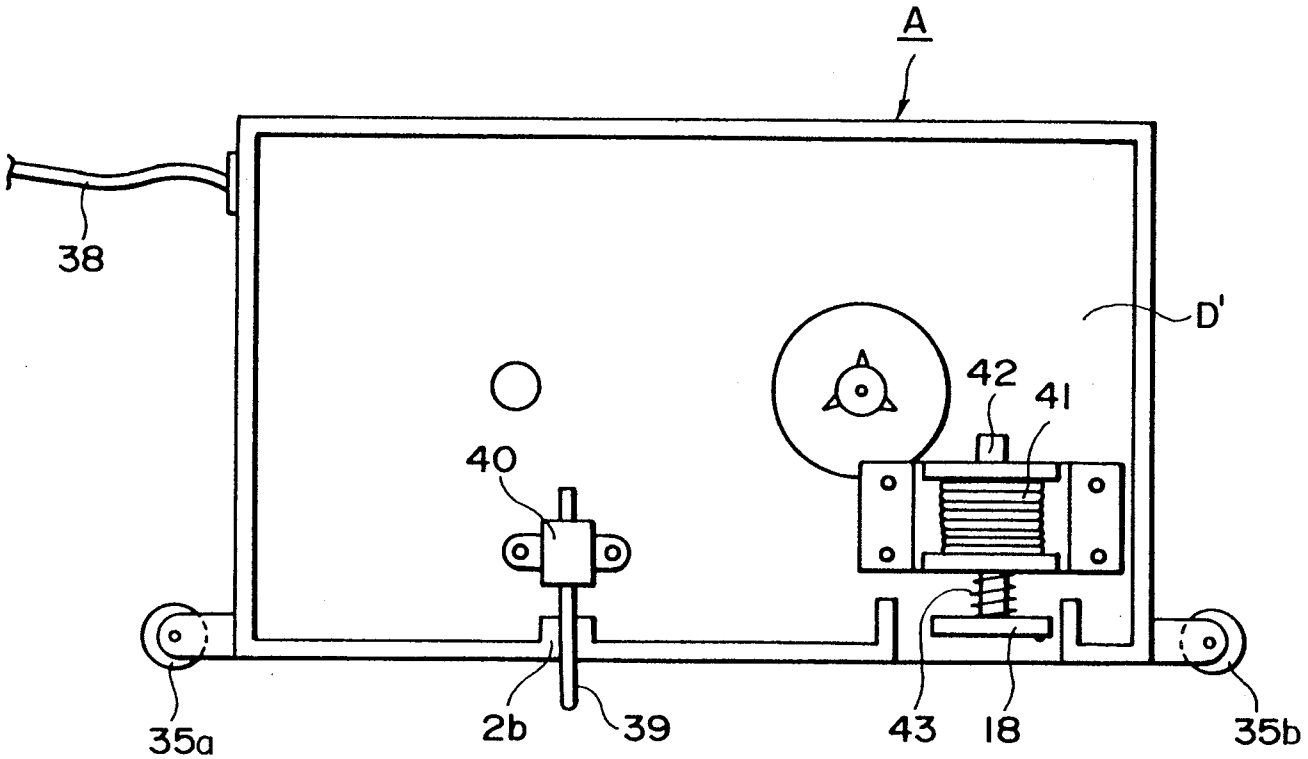
FIG. 6 illustrates another embodiment of the recording head mechanism D.

In the above-described embodiment, the head supporting arm 19 is operated with the roller 22 brought into contact with the recording paper 5. However, as shown, for example, in FIG. 6, a contact 39 may be exposed to the outside of the apparatus body A through the cut-away portion 2b of the lower case 2, and a microswitch 40 operated by this contact 39 may be provided in the apparatus body A. Also, the recording head mechanism D includes recording head 18 which may be adbersively or otherwise secured to the stem 42 of a solenoid 41 secured to the apparatus body A, with a compression coil spring 43 interposed therebetween, and may be pushed inwardly into the solenoid body by the contact 39 contacting the recording paper 5. Thereby, the contact 39 may come into engagement with the microswitch 40 and a contact signal may be produced by the microswitch 40, and the solenoid 41 may be driven for opening and closing by this signal to thereby press the recording head 18 against the recording paper 5 with the ink ribbon 17 interposed therebetween.

The present embodiment, as described just above, is designed such that movement of the solenoid body is detected and recording is effected in response to such movement and therefore, recording can be manually accomplished on thick paper or a booklet-like recording medium such as a notebook.

Also, if design is made such that movement of the apparatus body A is detected by the rotating member 7 and further the transfer medium is conveyed by the rotating member 7, it will be possible to always synchronize the movement of the apparatus body A with the driving of the recording head 18 and the conveyance of the transfer medium and as a result, unsatisfactory image transfer and the waste of the transfer medium can be eliminated.

Reference is now had to FIGS. 7 to 12 to describe still another embodiment of the present invention.

The embodiment described hereinafter has detecting means for detecting the movement of an apparatus body a recording medium, conveying means for conveying a transfer medium in response to the movement of said apparatus body, a recording head driven so as to transfer a transfer material on said transfer medium to said recording medium correspondingly to the movement of said apparatus body and in conformity with an image signal, pressing means for pressing said recording head toward the recording medium side correspondingly to the contact and separation between said apparatus body and said recording medium, and eliminating means for eliminating any slack of the transfer medium resulting from the contact and separation of said recording head with respect to the recording medium.

According to the present embodiment when the apparatus body is brought into contact with the recording medium, the recording head 18 is biased toward the recording medium side by the pressing means correspondingly thereto and is urged against the recording medium with the transfer medium interposed therebetween. When the apparatus body is then manually moved, the detecting means detects the amount and speed of movement of the apparatus body. In conformity with the result of the detection, the transfer medium is conveyed and the recording head is driven, whereby predetermined recording is effected on the recording medium. When the contact between the apparatus body and the recording medium is then released, the recording head is returned into the apparatus body by the pressing means and any slack of the transfer medium produced at this time is eliminated by the slack eliminating means.

The present embodiment will hereinafter be described with reference to the drawings.

Figure 7:
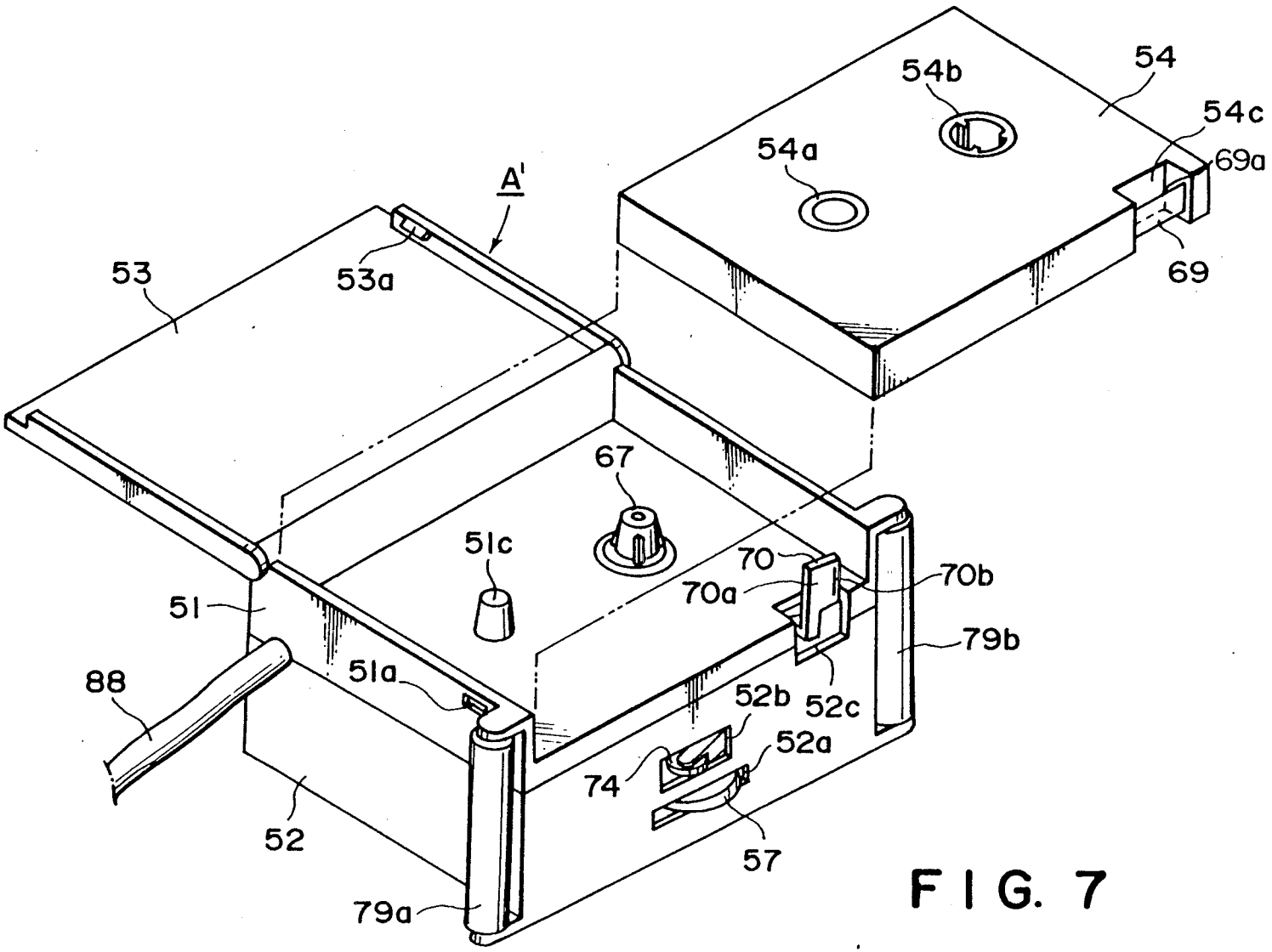
FIG. 7 is a perspective view of a manually scanned recording apparatus to which another embodiment of the present invention is applied.
Figure 9:
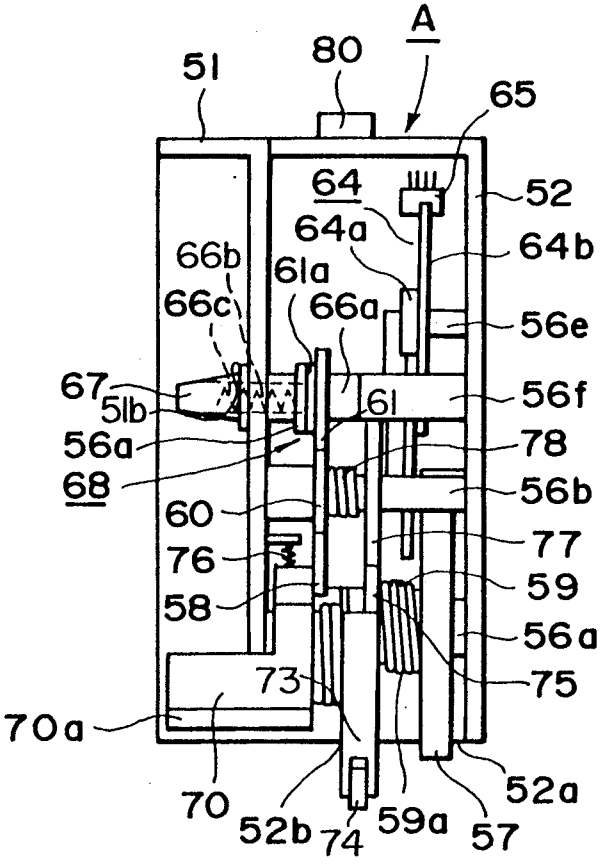
FIG. 9 is a side view of the recording apparatus shown in FIG. 7.
Figure 8:
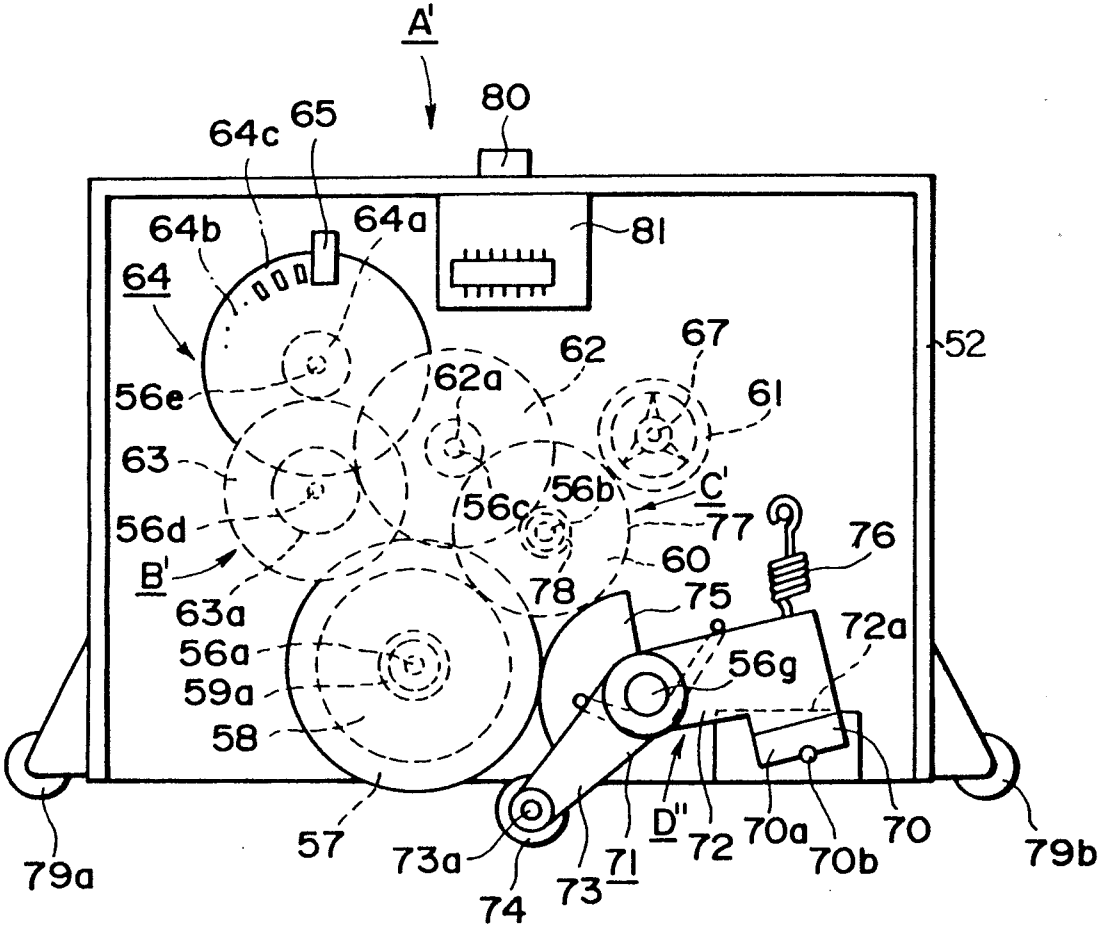
FIG. 8 is a front view of the recording apparatus shown in FIG. 7.
Figure 10:
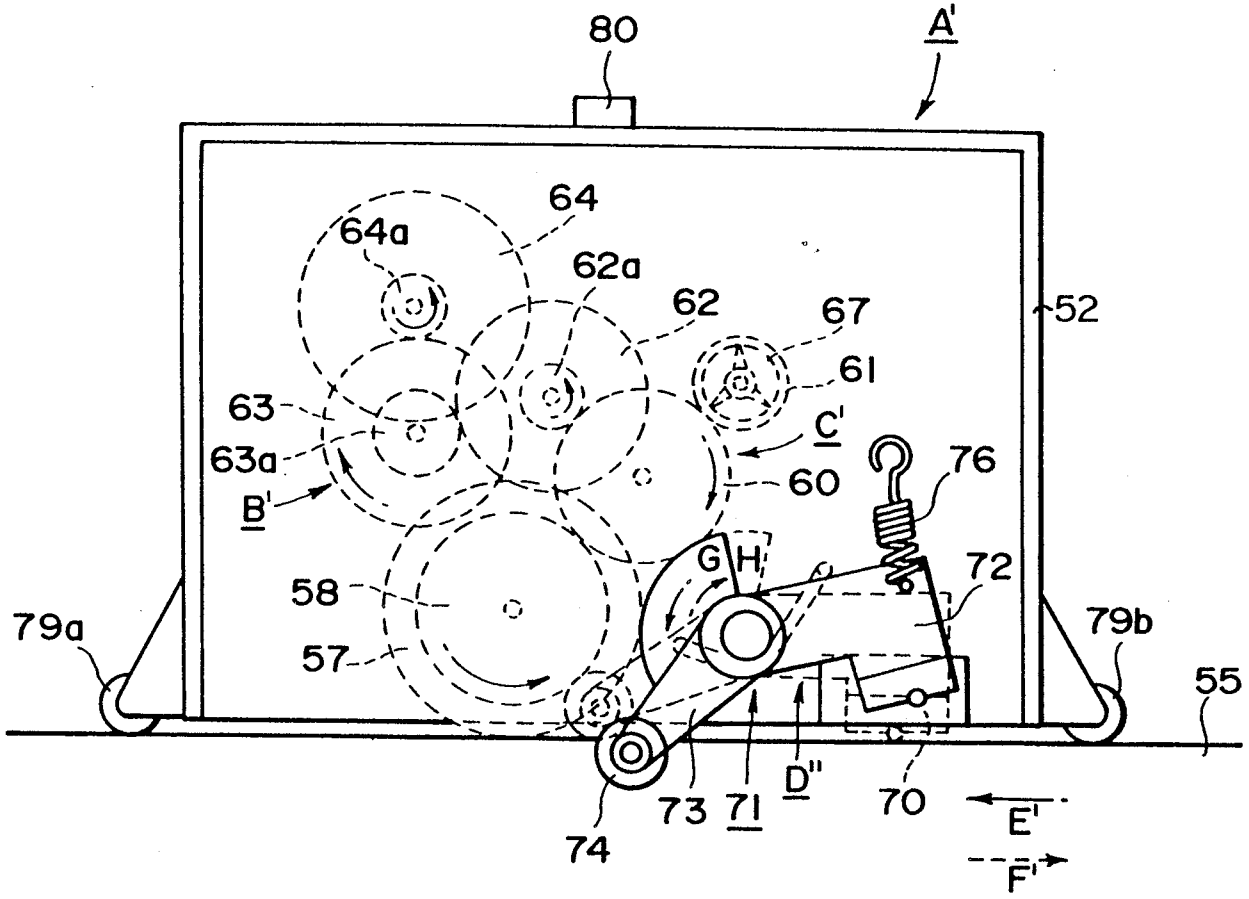
FIG. 10 illustrates the operation of the same recording apparatus.
Figure 11:
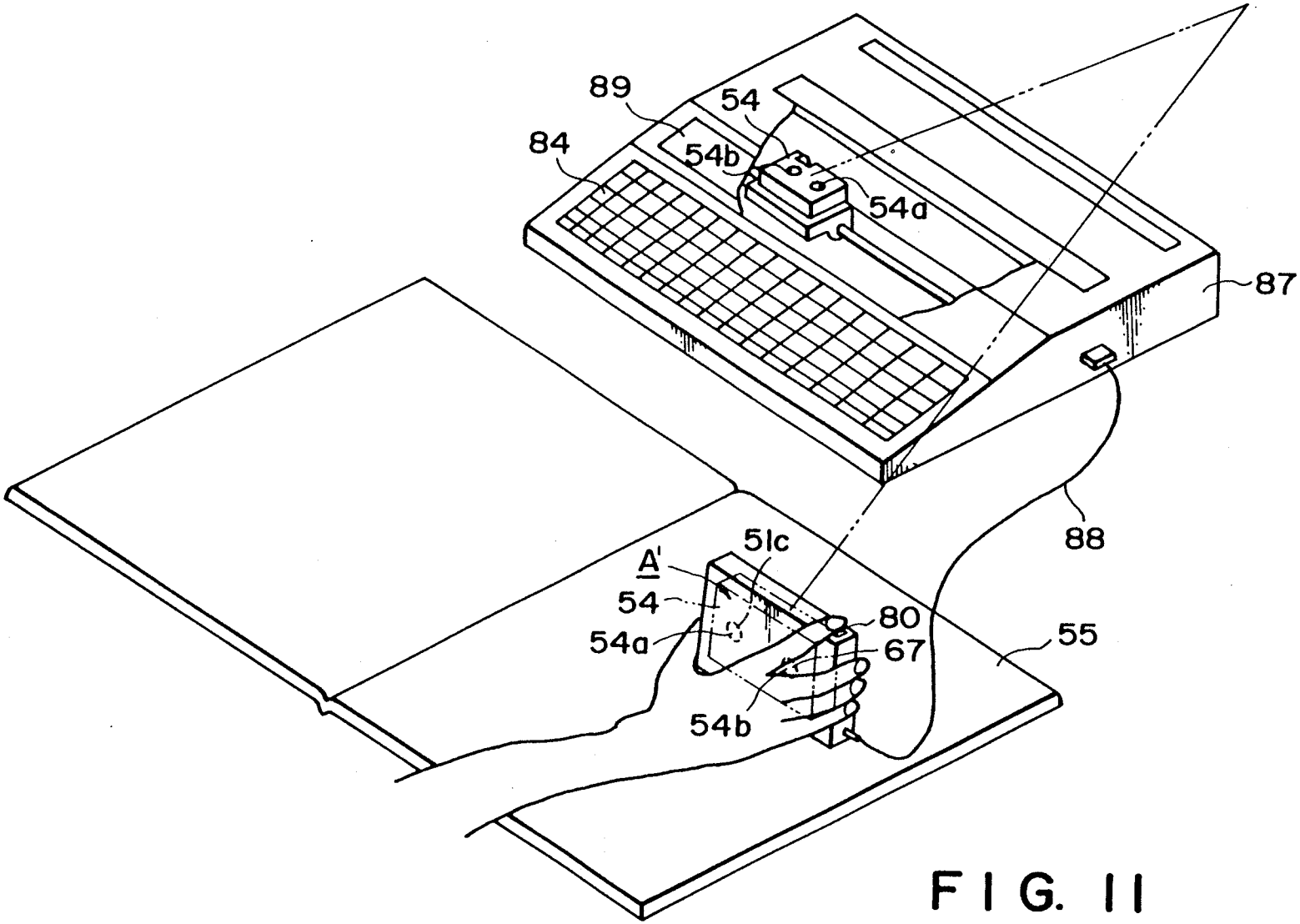
FIG. 11 illustrates a state in which the same recording apparatus carries out recording.
Figure 12:
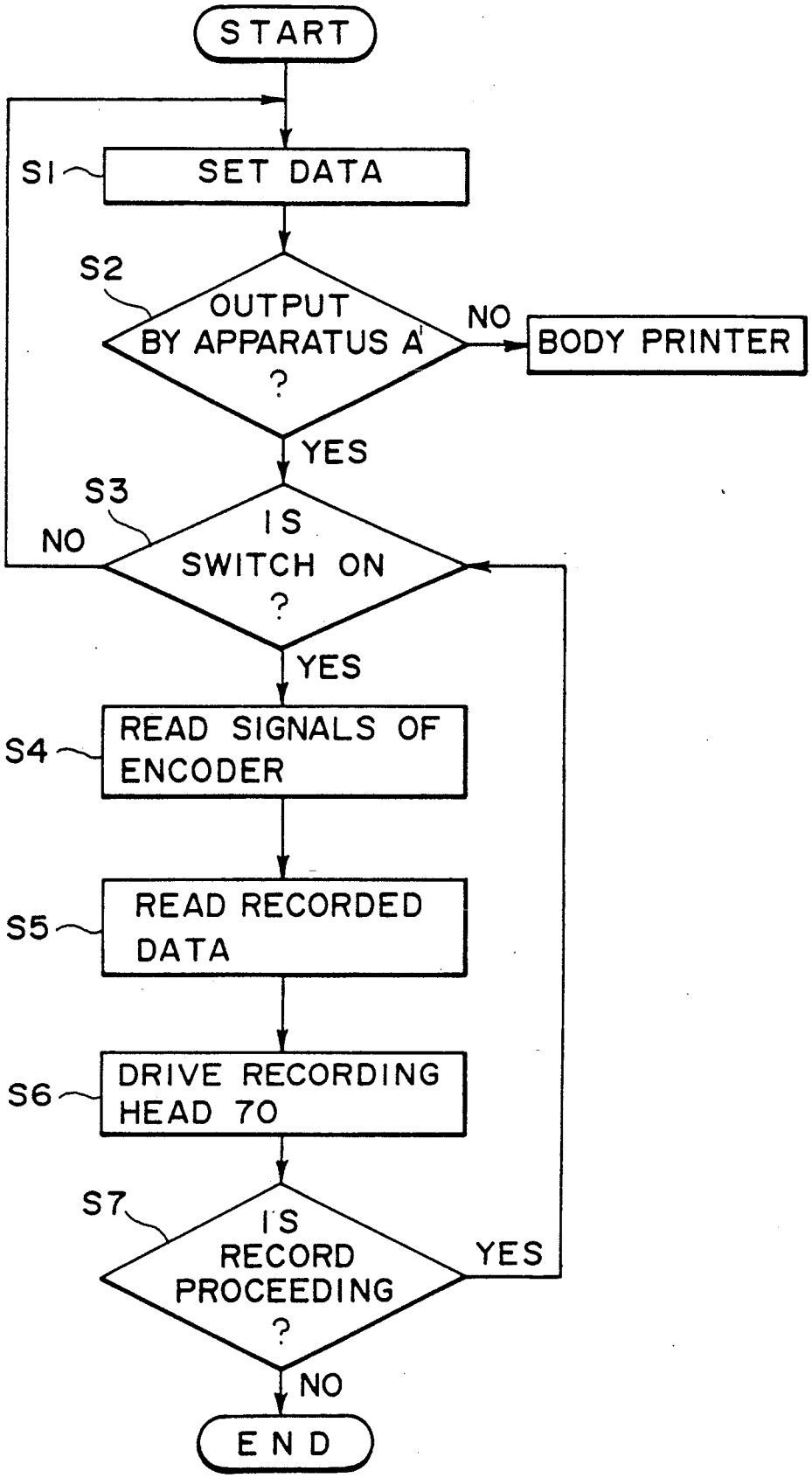
FIG. 12 is a flow chart.

FIG. 7 is a perspective view of the recording apparatus, FIG. 8 is a front view of the recording apparatus, and FIG. 9 is a side view of the recording apparatus. FIG. 10 illustrates the operation of the recording apparatus, FIG. 11 illustrates a state in which recording is effected, and FIG. 12 is a flow chart. A block diagram of this apparatus is similar to FIG. 5 and therefore need not be shown.

In these figures, the letter A' designates an apparatus body having an upper case 51 and a lower case 52 which can be integrally secured to each other by the screws 100 or the like. A lid member 53 is pivotally provided on the upper case 51. Restraining pawls 53*a* are provided on the opposite side edges of the lid member 53 and are engageable with restraining recesses 51*a* formed in the opposite sides of the upper case 51. An ink ribbon cassette 54 can be contained in the upper case 51, and a detecting mechanism B' for detecting the amount and speed of movement of the apparatus body A' to be described, a conveying mechanism C' for a transfer medium and a recording head mechanism D' are contained between the upper and lower cases 51 and 52. The apparatus body A' may be pushed against a recording medium (such as paper or a plastic sheet, hereinafter referred to as the "recording paper") 55 as shown in FIG. 11 and may be manually moved to thereby accomplish predetermined image recording.

The constructions of the mechanisms B', C' and D' will now be specifically described with reference to FIGS. 8 and 9.

The detecting mechanism B' will first be described. As shown, a running roller 57 is rotatably mounted on the shaft 56*a* of the lower case 52. The running roller 57 is partly exposed to the outside of the apparatus body A' through a cut-away portion 52*a* of the lower case 52. The running roller 57 is adapted to contact the recording paper 55 and be rotated by the friction therewith as the apparatus body A' is moved.

A gear 58 of slightly smaller diameter than the running roller 57 is provided on the running roller 57 with a spring 59*a* interposed therebetween, the spring 59*a* constituting a one-way clutch 59. The one-way clutch 59 may transmit the rotation of the running roller 57 to the gear 58 when the apparatus body A' is moved in the direction of arrow E' which is the direction in which recording is effected. The one-way clutch 59 is designed so as not to transmit the rotation of the running roller 57 when the apparatus body A' is moved in the direction of arrow F' which is the direction opposite to the direction in which recording is effected.

The rotation of the gear 58 resulting from the movement of the apparatus body A' in the direction of arrow E' may be accelerated and transmitted to the gear 64*a* of an encode plate 64 through an intermediate gear 60 meshing with the gear 58, an intermediate gear 62 meshing with the intermediate gear 60 through gear portion 62*a* and gear 63 meshing with the intermediate gear 62 through gear portion 63*a*. The intermediate gears 60, 62, 63 and the encode plate 64 are rotatably mounted on the shafts 56*b*, 56*c*, 56*d* and 56*e*, respectively, of the lower case 2.

The encode plate 64 has a gear 64*a* and a thin disc 64*b* of stainless steel or like material formed integrally with each other. A plurality of rectangular slits 64*c* are radially formed in the marginal portion of the disc 64*b*. Further, a photosensor 65 is provided at a position corresponding to the slits 64*c*. This photosensor 65 has a light-emitting portion and a light-receiving portion, and is mounted on the sensor mounting portion of the lower case 52 so that the light from the light-emitting portion may pass through the slits 64*c* to the light-receiving portion. Accordingly, when the apparatus body A' is moved in the direction of arrow E' and the running roller 57 is rotated, the encode plate 64 rotates correspondingly thereto and the photosensor 65 which has detected the slits 64c products a pulse signal as an encode signal. The amount and speed of rotation of the running roller 57 may be detected by such signal.

The conveying mechanism C' for the transfer medium will now be described. A rotary shaft 66a having one end formed in a rectangular shape and the other end formed in a cylindrical shape is rotatably mounted on the shaft 56f of the lower case 52. A gear 61 meshing with the aforementioned intermediate gear 60 is rotatably mounted on the cylindrical portion of the rotary shaft 66a. Further, a roll-up shaft 67 is press-fitted into the rectangular portion of the rotary shaft 66a with a disc 66b and a compression coil spring 66c interposed therebetween.

As described above, the gear 61 is loosely fitted for rotation relative to the rotary shaft 66a, and the disc 66b is loosely fitted against rotation relative to the rotary shaft 66a. A friction plate 61a formed of felt or like material is adhesively or otherwise secured to the upper surface of the gear 61. The disc 66b is biased by the compression coil spring 66c and urged against the friction plate 61a to thereby constitute a friction clutch 68.

The roll-up shaft 67 is designed to be exposed through an opening 54b formed in the upper case 51. A support shaft 51c projectedly provided on the upper case 51. When the ink ribbon cassette 54 is inserted into the upper case 51, the supply reel 54a of the ink ribbon cassette 54 is rotatably supported by the support shaft 51c. The take-up reel 54b is fitted against rotation relative to the roll-up shaft 67.

The ink ribbon cassette 54 used may be the same as that used in an outside instrument 87 as shown in FIG. 11. That is, the relation between the support shaft 51c and the roll-up shaft 67 is identical to that portion of the outside instrument 87 which carries an ink ribbon cassette.

An ink ribbon 69 which is the transfer medium is wound on the supply reel 54a and the take-up reel 54b, and as the roll-up reel 54b is rotated, the ink ribbon 69 is successively paid away from the supply reel 54a to the take-up reel 54b.

The ink ribbon 69 comprises a base film formed of polyethylene terephthalate film or the like, and ink meltable or reducible in viscosity by heating and applied onto the base film 69a . The ink ribbon 17 is pressed from its base film side by a recording head 70 to be described, whereby it is loaded so that the surface thereof to which the ink is applied can contact the recording paper 55.

In the above-described construction, when the apparatus body A' is moved in the direction of arrow E' and the running roller 57 is rotated with said movement, the gear 61 is rotated through the intermediary of the intermediate gear 60. The rotational force thereof is transmitted to the disc 66b through the frictional force of the friction plate 61a, whereby the roll-up shaft 67 is rotated. Thereby the take-up reel 54b is rotated and the ink ribbon 69 is successively rolled up on the take-up reel 54b.

During the rolling-up of the ink ribbon 69, no rotational force exceeding a predetermined level is transmitted to the roll-up shaft 67 due to the aforedescribed action of the friction clutch 68.

The recording head mechanism D' will now be described. Is shown, the recording head 70 has a head substrate 70a and heat generating elements 70b arranged in a row on the head substrate 70a, the heat generating elements 70b being adapted to individually generate heat by being electrically energized. The recording head 70 is adhesively or otherwise secured to the end portion 72a of a head link 72 which constitutes an arm 71.

The arm 71 is generally formed in a dog-legged shape with the head link 72 made integral with a roller link 73. The arm 71 is rotatably mounted substantially at its central portion on the shaft 56g of the lower case 52.

A roller 74 is rotatably mounted on the end portion 73a to the roller link 73. It is exposed to the outside of the apparatus body A through the cut-away portion 52b of the lower case 52. A sector gear 75 rotatable about a shaft 56g is provided on the roller link 73.

A tension coil spring 76 is provided between the lower case 52 and the back surface which is the end portion 72a of the head link 72 and to which the recording head 70 is secured. Accordingly, the arm 71 is normally biased by the tension coil spring 76 so that the recording head 70 may be contained inside the apparatus body A'.

The sector gear 75 is in meshing engagement with a gear 77 provided on the shaft 56b, and the gear 77 is connected to the intermediate gear 60 through a one-way clutch 78. This one-way clutch 78 is designed so as to be capable of transmitting clockwise rotation of the gear 77. That is, when the sector gear 75 is rotated in the direction of arrow G in FIG. 10, the one-way clutch may transmit this rotation to the intermediate gear 60.

Guide rollers 79a and 79b for guiding the movement of the apparatus body A' are provided on the opposite ends of the upper and lower cases 51 and 52.

In a state in which recording is not effected, the recording head mechanism D' constructed as described above is such that the arm 71 is biased by the tension coil spring 76 and the recording head 70 is contained within the apparatus body A'. When recording is to be effected, the apparatus body A' is placed on the recording paper 55. Thereupon, the roller 74 first comes into contact with the recording paper 55, whereby the arm 71 is rotated about the shaft 56g in the direction of arrow H indicated in FIG. 10. At this time, the rotation of the sector gear 75 is transmitted to the gear 77, but not to the intermediate gear 60 due to the action of the one-way clutch 78. When the roller 74 and the guide rollers 79a and 79b become flush with each other, the rotation of the arm 71 stops. The recording head 70 thus becomes exposed to the outside of the apparatus body A' through the cut-away portion 52c of the lower case 52 and is urged against the recording paper 55 with the ink ribbon 69 interposed therebetween.

The recording head 70 and the photosensor 65 and further a record initiating switch 80 are electrically connected to a circuit substrate 81 by a flexible substrate or the like, not shown but substantially equivalent to element 26 in FIG. 2. A control circuit as shown in FIG. 5 is provided on the circuit substrate 81, and the driving of the recording head 70 is controlled by this control circuit.

The above-mentioned control circuit is constructed as shown in FIG. 5 to which reference has already been made, and the description of FIG. 5 applies to this control circuit.

Description will now specifically be made of the slack eliminating mechanism for eliminating any slack of the ink ribbon 69.

The ink ribbon cassette 54 is first inserted into the upper case 51 in the state shown in FIG. 7. At this time, the recording head 70 is biased by the tension coil spring 76 and contained within the apparatus body A' and is fitted in the recess 54c in the ink ribbon cassette 54. When the operator then places the apparatus body A' on the recording paper 55 as shown in FIGS. 10 and 11, the roller 74 come into contact with the recording paper 55 and rotates the arm 71 in the direction of arrow H. By this rotation the recording head 70, with the ink ribbon 69, is exposed to the outside of the apparatus body A' through the cut-away portion 52c of the lower case 52 and is urged against the recording paper 55. The rotation of the sector gear (5 resulting from the rotation of the arm 71 in the direction of arrow H is transmitted to the gear 77, but not to the intermediate gear 60 due to the action of the one-way clutch 78. Accordingly, this rotation is effected independently of the roll-up shaft 67.

Recording is then terminated and the operator raises the apparatus body A' from the recording paper 55 to space the apparatus body apart A from the recording paper 55. Thereupon, the arm 71 is rotated in the direction of arrow G by the action of the tension coil spring 76, and by this rotation, the recording head 70 is returned into the apparatus body A' and the roller 74 restores its initial state. The then rotation of the arm 71 in the direction of arrow G is transmitted to the gear 77 by the sector gear 75, causes rotation of the intermediate gear 60 through the one-way clutch 78 and causes rotation of the take-up shaft 67, thereby effecting the roll-up of the ink ribbon 69. By this take-up, any slack of the ink ribbon 69 produced when the recording head 70 is retracted into the apparatus body A' is eliminated.

Reference is now had to FIG. 11 and the flow chart of FIG. 12 to describe a case where a recorded image is formed on the recording paper 55 by the use of the recording apparatus constructed as described above.

As shown in FIG. 11, an outside instrument 87 for inputting recording information, such s a word processor or an electronic typewriter, and the control circuit of the apparatus body A' are electrically connected together by a cord 88. At step S1, data is input and set by the keyboard 84 of the outside instrument 87. Then at step S2, whether the set data should be recorded by the body printer of the outside instrument 87 or by the apparatus body A' is judged, and if the set data should be recorded by the apparatus body A' advance is made to step S3.

To record the input information displayed on the display part 89 of the outside instrument, the apparatus body A' is placed on booklet-like recording paper 55 such as a notebook. Thereupon, the roller 74 receives a force from the recording paper 55 and the arm 71 rotates in the direction of arrow H to thereby urge the recording head 70 against the recording paper 55 with the ink ribbon 69 interposed therebetween.

At step S3, whether the record initiating switch 80 is ON is judged, and if it is ON, advance is made to step S4, where the signals of the encoder are read. That is, with the apparatus body A' placed on the recording paper 55, the operator manually moves the apparatus body A' in the direction of arrow E' while depressing the record initiating switch 80. Thereupon, the running roller 57 which is it contact with the recording paper 55 rotates, and the amount and speed of rotation hereof are detected by the encode plate 64 and the photosensor 65. This detection is such that the amount of movement of the apparatus body A' is detected by the pulse number from the initiation of the movement and the speed of movement of the apparatus body A' is detected by the pulse period.

At step S5, the recorded information stored in RAM 31 correspondingly to the result of said detection is read, and at step S6, the recording head 70 is driven in conformity with said information. Accordingly, even if the speed of movement of the apparatus body A' changes, image recording is effected always correspondingly to the speed.

At the same time, the roll-up shaft 67 is rotated by the rotation of the running roller 57 resulting from the movement of the apparatus body A', and the ink ribbon 69 after recording is successively rolled up onto the take-up reel 54b. As the ink ribbon 69 is rolled up, the diameter of the ink ribbon 69 rolled up onto the take-up reel 54b varies. Accordingly, it is necessary to vary the amount of rotation of the take-up reel 54b for the amount of movement of the apparatus body A'. However, as previously described, a rotational torque corresponding to the amount of rotation of the running roller 57 is transmitted to the roll-up shaft 67 through the friction clutch 68. Therefore, irrespective of the variation in said diameter, the ink ribbon 69 may be rolled up by an amount corresponding to the amount of rotation of the running roller 57.

At step S7, whether recording should be continued is judged, and if recording should be continued, return is made to step S3. and if recording should be terminated, the program comes to an end.

The recording apparatus described in the present embodiment can accomplish recording by the apparatus body A' being moved, as described above, and therefore the recording medium is not limited to a sheet-like one, but recording can also be effected easily on a thick recording medium and a booklet-like recording medium. Also, the driving of the recording head 70 and the rotation of the roll-up shaft 67 take place in synchronism with the rotation of the running roller 57. So, it never happens that the ink ribbon 69 fails to be conveyed and only the recording head 70 is driven, and likewise, it never happens that the recording head 70 fails to be driven and only the ink ribbon 69 is conveyed.

The above-described embodiments have been shown with respect to an example in which the detection of the amount of movement of the apparatus body A' and the conveyance of the ink ribbon 17, 69 are accomplished by the rotation of the rotational member 7 or the running roller 57, but alternatively such detection and conveyance may be accomplished by discrete constructions.

The rotational member 7 or the running roller 57 need not be limited to a roller-like member but use may be made, for example, of an endless belt or the like rotated.

Further, in the above-described embodiments, the rotation of the rotational member 7 or the running roller 57 is detected by a combination of the encode plate 10, 64 and the photosensor 11, 65. However, the present invention need not be restricted thereto, but alternatively, instead of the encode plate 10, 64, the rotation of a magnetic pole plate having north and south poles alternately arranged may be detected to thereby detect the amount of rotation of the rotational member 7 or the running roller 57.

Also the above-described embodiments have been shown with respect to an example of the heat transfer recording system in which the ink ribbon 17, 69 having applied thereto ink meltable or reducible in viscosity by heat is used as the transfer medium and recording is effected by the recording head 18, 70, but alternatively, the wire dot type recording system or the ink jet system whereby ink is protruded from a nozzle to thereby accomplish image recording is applicable.

Also, the above-described embodiments have been shown with respect to an example in which the outside instrument 36, 87 is discretely provided so that the recorded information from the outside instrument 36, 87 is recorded. However, as an alternative example, the outside instrument 36, 87 may be made integral with the recording apparatus and all the mechanisms shown in FIG. 5 may be contained in the apparatus body A so that the recoding apparatus can be used singly.

Also, in the aforedescribed embodiment, the ink ribbon cassette 54 used in the apparatus body A' may be the same as the ink ribbon cassette used in the outside instrument 87 and therefore, efficient recording can be accomplished.

As described above, the present invention is designed such that the operator manually moves the apparatus body on the recording medium and this movement is detected and correspondingly to said movement, recording is effected in conformity with image signals. Therefore, recording can be easily accomplished even on a booklet-like recording medium such as thick paper or a notebook.

Also the recording head is designed to be brought into or out of the apparatus body with the contact or separation between the apparatus body and the recording medium. Therefore, during non-recording, the recording head can always be contained in the apparatus body and cannot be damaged. Further, the provision of the means for eliminating any slack of the ink ribbon leads to the possibility of eliminating any slack of the ink ribbon produced when the recording head is returned into the apparatus body after recording is terminated, to thereby ensure the ink ribbon is used in its tensioned condition. Thereby, any trouble such as oblique movement of the ink ribbon during recording can be prevented.

As described above in detail, the present invention has means for displacing the recording means to the recording position by the contact between the hand recording apparatus body and the recording medium and can therefor eliminate any mistake in recoding and obtain clear-cut recorded images.

We claim:

1. A hand recording apparatus for recording images on a recording medium by manual operation, said apparatus comprising:

detecting means for detecting the movement of the apparatus;

recording means driven so as to record an image conforming to an image signal on said recording medium correspondingly to the movement of said apparatus detected by said detecting means, said recording means being shiftable between a recording position and a retracted position; and displacing means for automatically shifting said recording means to the recording position in response to contact between said apparatus and said recording medium.

2. A hand recording apparatus according to claim 1, wherein said recording means is a thermal head having a plurality of heat generating elements.

3. A hand recording apparatus according to claim 1, wherein said apparatus is provided with an ink ribbon having ink applied thereto.

4. A hand recording apparatus according to claim 1, wherein said apparatus has conveying means for conveying an ink ribbon having ink applied thereto, in response to the movement of said apparatus body.

5. A hand recording apparatus according to claim 1, wherein said recording means presses said recording medium with an ink ribbon having ink being interposed therebetween.

6. A hand recording apparatus as in claim 1, wherein said image signal is input by an external device provided separately from said hand recording apparatus.

7. A hand recording apparatus as in claim 1, wherein said recording means records on a recording medium by utilizing an ink jet system for recording by discharging ink.

8. A hand recording apparatus for recording images on a recording medium by manual operation, said apparatus:

detecting means for detecting the movement of the apparatus;

conveying means for conveying an ink sheet having ink in response to the movement of said apparatus;

recording means driven so as to record an image conforming to an image signal on said recording medium correspondingly to the movement of said apparatus detected by said detecting means, said recording means being shiftable between a recording position and a retracted position; and displacing means for automatically shifting said recording means to the recording position with said ink sheet interposed therebetween, in response to contact between said apparatus and said recording medium.

9. A hand recording apparatus as in claim 8, wherein said image signal is input by an external device provided separately from said hand recording apparatus.

10. A hand recording apparatus as in claim 8, wherein said recording means records on a recording medium by utilizing an ink jet system for recording by discharging ink.

11. A hand recording apparatus for recording images on a recording medium by manual operation, said apparatus comprising:

detecting means for detecting the movement of the apparatus;

conveying means for conveying an ink sheet having ink in response to the movement of said apparatus;

recording means driven so as to record an image conforming to an image signal on said recording medium correspondingly to the movement of said apparatus detected by said detecting means, said recording means being shiftable between a recording position and a retracted position;

displacing means for automatically shifting said recording means between a recording position and a retracted position retracted from said recording position, in response to the contact and separation between said apparatus and said recording medium; and slack eliminating means for eliminating any slack of said ink sheet resulting from the displacement of said recording means between said recording position and said retracted position.

12. A hand recording apparatus according to claim 11, wherein said recording means is a thermal head having a plurality of heat generating elements.

13. A hand recording apparatus according to claim 11, wherein said recording means presses said recording medium with said ink sheet interposed therebetween.

14. A hand recording apparatus according to claim 11, wherein said slack eliminating means effects roll-up of said ink sheet.

15. A hand recording apparatus according to claim 11, wherein said means for displacing said recording means and said slack eliminating means are operatively associated with each other.

16. A hand recording apparatus as in claim 11, wherein said image signal is input by an external device provided separately from said hand recording apparatus.

17. A hand recording apparatus as in claim 11, wherein said recording means records on a recording medium by utilizing an ink jet system for recording by discharging ink.

* * * * *

UNITED STATES PATENT AND TRADEMARK OFFICE

CERTIFICATE OF CORRECTION

PATENT NO. : 4,999,016

DATED : March 12, 1991

INVENTOR(S) : TAKESHI SUZUKI ET AL.

It is certified that error appears in the above-identified patent and that said Letters Patent is hereby corrected as shown below:

On the title page:

AT [56] REFERENCES CITED

Foreign Patent Documents, "59-11074" should read --59-114074--, "59-11078" should read --59-114078--; and "0145166 8/1984 Japan ... 400/88" should be deleted.

COLUMN 3

Line 59, "Lightreceiving" should read --light-receiving--.

COLUMN 4

Line 26, "roll-up reel 4*b*" should read --take-up reel 4*b*--.

COLUMN 6

Line 8, "thereby" should read --whereby--.
Line 34, "very" should read --vary--.
Line 66, "adbersively" should read --adhesively--.

COLUMN 7

Line 28,"body" should read --body on--.
Line 43, "embodiment" should read --embodiment,--.

UNITED STATES PATENT AND TRADEMARK OFFICE

CERTIFICATE OF CORRECTION

PATENT NO. : 4,999,016

DATED : March 12, 1991

INVENTOR(S) : TAKESHI SUZUKI ET AL.

It is certified that error appears in the above-identified patent and that said Letters Patent is hereby corrected as shown below:

COLUMN 9

Line 2, "products" should read --produces--.
Line 26, "projectedly" should read --is projectedly--.
Line 40, "roll-up reel 54*b*" should read --take-up reel 54*b*--.
Line 66, "Is" should read --As--.

COLUMN 10

Line 11, "to" (first occurrence) should read --of--.
Line 55, "shown" should read --shown,--.

COLUMN 11

Line 6, "come" should read --comes--.
Line 12, "sector gear (5" should read --sector gear 75--.
Line 19, "apart A" should read --A' apart--.
Line 37, "s" should read --as--.
Line 46, "A' advance" should read --A', advance--.

UNITED STATES PATENT AND TRADEMARK OFFICE

CERTIFICATE OF CORRECTION

PATENT NO. : 4,999,016

DATED : March 12, 1991

INVENTOR(S) : TAKESHI SUZUKI ET AL.

It is certified that error appears in the above-identified patent and that said Letters Patent is hereby corrected as shown below:

COLUMN 13

Line 29, "Also" should read --Also,--.
Line 47, "therefor" should read --therefore--.

COLUMN 14

Line 7, delete "body".
Line 22, "ratus:" should read --ratus comprising:--.

Signed and Sealed this

Thirteenth Day of October, 1992

*Attest:*

DOUGLAS B. COMER

*Attesting Officer*

*Acting Commissioner of Patents and Trademarks*